US005333764A

United States Patent [19]

Kassuba

[11] Patent Number: 5,333,764

[45] Date of Patent: Aug. 2, 1994

[54] LADLE STOPPER ROD CONTROL ARRANGEMENT

[75] Inventor: Steven M. Kassuba, Gaylord, Mich.

[73] Assignee: CSI Industrial Systems, Corp., Grayling, Mich.

[21] Appl. No.: 64,835

[22] Filed: May 19, 1993

[51] Int. Cl.[5] ..... B22D 41/20

[52] U.S. Cl. ..... 222/602; 266/236

[58] Field of Search ..... 222/602, 590, 591, 597; 266/236, 78, 92

[56] References Cited

U.S. PATENT DOCUMENTS

| | | | |
|---|---|---|---|
| 2,832,110 | 4/1958 | Carleton, Jr. | 222/602 |
| 3,465,811 | 9/1969 | De Castelet | 222/602 |
| 3,733,014 | 5/1973 | Pflaum | 222/602 |
| 3,762,605 | 10/1973 | Seaton | 222/602 |

*Primary Examiner*—Scott Kastler
*Attorney, Agent, or Firm*—Lon H. Romanski

[57] ABSTRACT

A system for pouring molten material from a ladle having a pouring nozzle and a cooperating stopper rod is shown having a pressure responsive piston and cylinder assembly effective for causing the initial opening of the stopper rod for providing a relatively high rate of flow of molten material through the nozzle; a linear transducer coupled with the piston and cylinder assembly assures that the piston has the opportunity to move a preselected distance within the cylinder to thereby in turn assuring that the stopper rod will also move to a preselected open position with respect to the nozzle.

12 Claims, 5 Drawing Sheets

LADLE STOPPER ROD CONTROL ARRANGEMENT

FIELD OF THE INVENTION

This invention relates generally to ladles for pouring liquids into a receiving receptacle and more particularly to such ladles having a pouring nozzle opened and closed by a cooperating stopper rod and, still more particularly, to control means for accurately positioning the stopper rod with respect to the pouring nozzle as to thereby obtain accurate repeatability of motion and position of the stopper rod.

BACKGROUND OF THE INVENTION

In the art of relatively high production of casting molten metals, a ladle containing the molten metal is usually maintained stationary while a series of molds are sequentially brought into flowing registry with the nozzle of the ladle. A stopper rod is employed to open the nozzle for the pouring of the molten metal from the ladle and into the cooperating mold.

One of the factors in determining the rate of pouring (flow) of molten metal from the ladle to the receiving mold is the degree to which the ladle nozzle has been opened by the stopper rod. Generally, the best castings are obtained by having a relatively high rate of flow of molten metal as the initial flow from the ladle to the mold. However, such relatively high rate of flow is, nevertheless a preselected rate which will provide the best results in the item to be molded. This, in turn, requires that when, for example, a exactly the same position as did the replaced stopper rod when it was moved to its initial opened position.

Prior art methods and arrangements are not always capable of assuring that the replacing stopper rod will move to such same initial opened position. Consequently, pour rates are varied not only at the initial opening of the replacing stopper rod but also throughout the entire pouring cycle which is comprised of a series of differing rates of pour.

The invention as herein disclosed and described is primarily directed to solving the aforestated problems of the prior art as well as other related and attendant problems.

SUMMARY OF THE INVENTION

According to the invention, apparatus for controllably pouring molten material from a ladle having a pouring nozzle, comprises a stopper rod for opening and closing said nozzle, a stopper rod support structure, wherein said support structure comprises manually adjustment means for adjusting the position of said stopper rod relative to said support structure, pressure responsive piston and cylinder means operatively connected to said support structure and effective to move said support structure and said stopper rod to a preselected opened position relative to said nozzle, wherein prior to said piston and cylinder means moving said support structure said support structure and stopper rod are in a position wherein said stopper rod is closed against said nozzle and said piston of said piston and cylinder means is situated a preselected distance away from an end travel of said piston, and further when said piston is at said preselected distance and produce an output signal indicative thereof.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
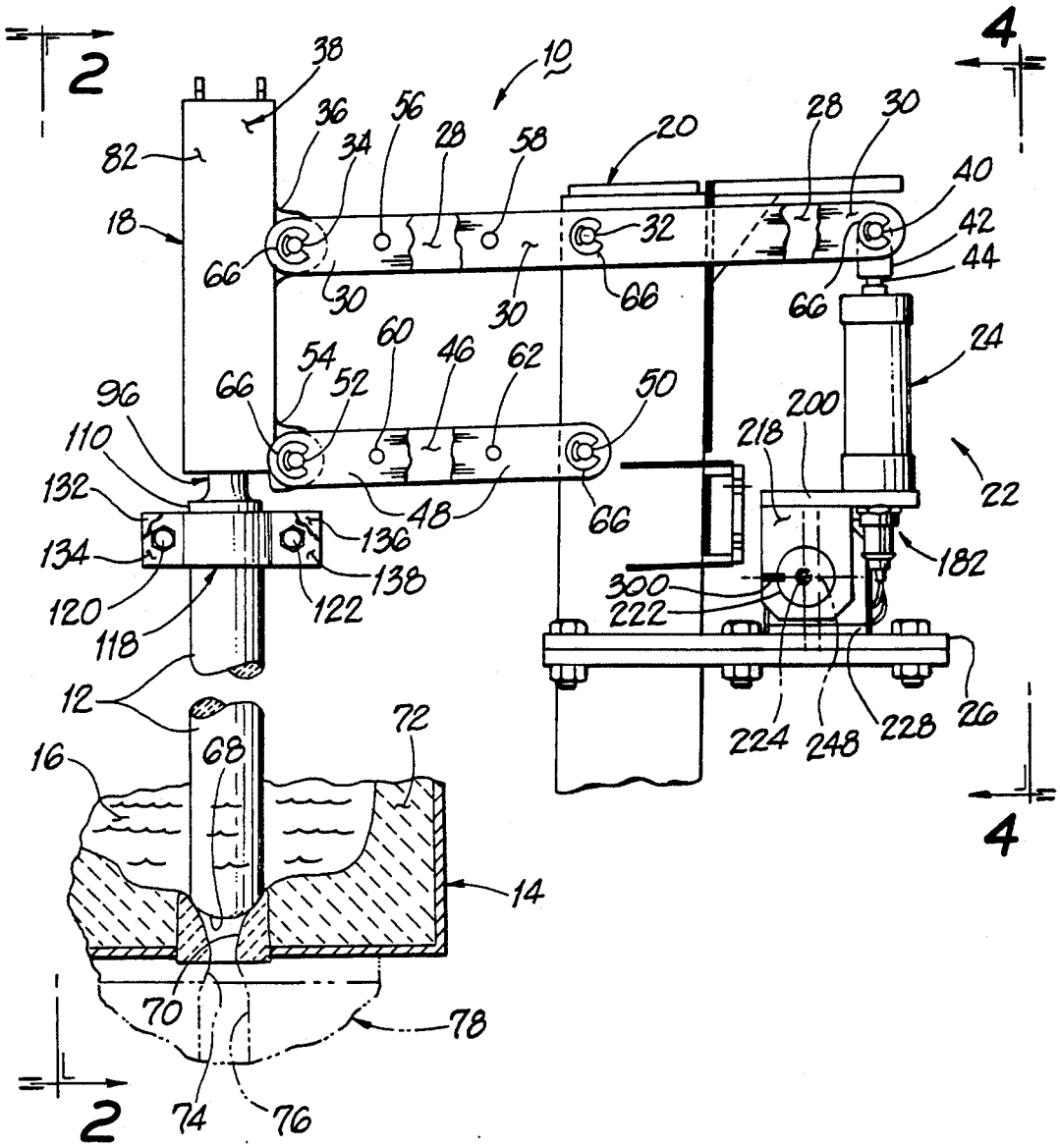
FIG. 1 is a fragmentary elevational view of a stopper rod actuating and control arrangement, employing teachings of the invention, along with a fragmentary portion of a ladle shown in cross-section.

Referring now in greater detail to the drawings, FIG. 1 illustrates an overall assembly 10 for positioning and actuating a stopper rod 12 relative to a ladle or vessel 14 containing molten material 16. Generally, the assembly 10 is depicted as comprising a rod tower assembly 18, a lift tower assembly 20 and a lifting assembly 22. In the preferred arrangement, the lifting assembly 22 comprises a fluid pressure actuated piston and cylinder assembly 24 which, further in the preferred embodiment, is pneumatic. The entire lifting assembly 22 may be suitably secured, as at its lower end, to a flange-like support structure 26 in turn secured to the lift tower 20 as by, for example, welding.

A first pair of lever arms 28 and 30 functionally identical to each other are pivotally supported, on respective opposite sides of the lift tower 20, as by a pivot rod or pin 32 passing through lever arms 28 and 30 and lift tower 20. The left-most ends (as viewed in FIG. 1) of lever arms 28 and 30 are pivotally connected to the rod tower assembly 18 as by a pivot rod or pin 34 passing through the lever arms 28 and 30 and through tabs, ears or other suitable journal 36 fixedly carried by the rod tower 18 housing or body 38.

The right-most ends (as also viewed in FIG. 1) of lever arms 28 and 30 have a pivot rod or pin 40, passing therethrough, to which a suitable fitting 42, carried by the projecting end of the piston rod 44 of assembly 24, is operatively pivotally connected.

A second pair of lever arms or linkages 46 and 48 are similarly pivotally connected, at their right-most ends, to the lift tower structure 20 as by a pivot rod or pin 50. The left-most ends of linkages 46 and 48 are pivotally connected to the rod tower assembly 18 as by a pivot rod or pin 52 passing through tabs, ears or other suitable journal 54 fixedly carried by the rod tower 18 housing or body 38.

Suitable generally transversely extending reinforcing members extending generally between and to each of lever arms 28 and 30 may be secured to such arms 28 and 30 as by welding and typically depicted at 56 and 58. Similarly, reinforcing members may extend between and to linkages 46 and 48 and be secured to such linkages as by welding and typically depicted at 60 and 62.

Figure 2:
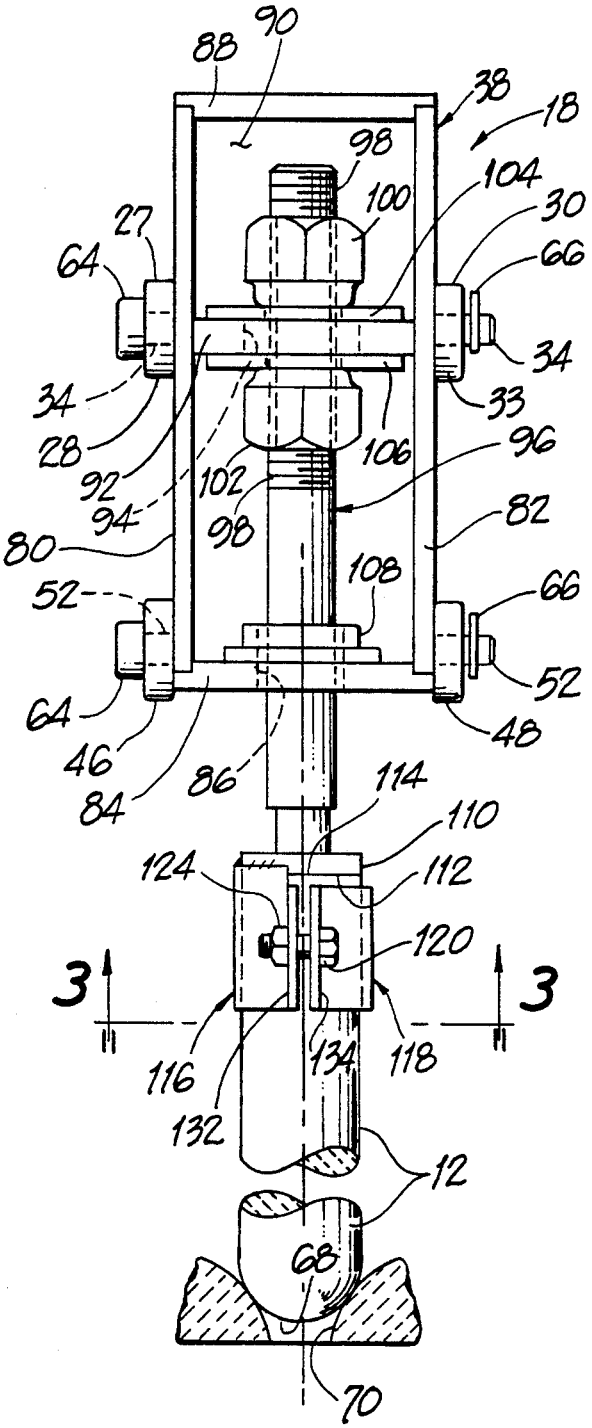
FIG. 2 is a relatively enlarged view taken generally on the plane of line 2—2 of FIG. 1 and looking in the direction of the arrows.

In the preferred arrangement, the respective ends of the pivot rods or pins not seen in FIG. 1 are provided with an integral head portion typically illustrated at 64—64 of FIG. 2 while the opposite ends of such pivot rods or pins are each formed with a circumferential groove which, in turn, permits a locking C-clip 66—66 or the like to be received thereby.

As should be apparent pivot rods or pins 34, 32 and 52, 50 along with linkages 46, 48 and the portions of arms 28 and 30, generally connected by pins 34 and 32 comprise a four-bar linkage which will pivot clockwise or counter-clockwise about pivots 32 and 50 depending upon whether the actuating assembly 22 causes the pivot or drive rod 40 downward or upward, respectively.

As shown in FIG. 1, the lower end 68, suitably contoured, of stopper rod 12 is sealingly seated against a cooperating seating area provided as by the ladle nozzle 70. As is well known in the art, the ladle or vessel 14 may be suitably lined with an appropriate refractory material 72 and, likewise, the nozzle 70 is preferably comprised of a suitable refractory material.

When, in FIG. 1, the stopper rod 12 is raised the resulting clearance between the end 68 of stopper rod 12 and nozzle 70 permits the flow of molten material from the ladle 14 chamber, through the nozzle 70 and via suitable associated passageways 74 and 76 to associated mold means or assemblies 78.

Referring now also to FIG. 2, the rod tower assembly 18 is illustrated as preferably comprising a housing or body 38 which, in turn, is comprised of opposed vertically extending side walls 80 and 82 which at their respective lower ends are joined, for example as by welding, to a lower end wall 84 provided with a clearance passage 86 formed therethrough. Similarly, the respective upper ends of side walls 80 and 82 are joined, for example as by welding, to an upper or top end wall 88. If desired, a third vertically extending wall 90, at the rear of body 38 as viewed in the drawing, may also be fixedly secured to top and bottom walls 88, 84 and to side walls 80, 82.

The rod tower housing 38 is also provided with a generally inner situated support wall 92 which is suitably fixedly secured to side walls 80 and 82 and, if a rear wall 90 is employed, such support wall 92 may also be suitably fixedly secured to the rear wall 90.

The support wall 92 is provided with a clearance passage 94 formed therethrough for permitting the extension therethrough of the stopper rod 12 support shaft 96.

The upper portion of support shaft 96 has an external thread 98 which threadably coacts with relatively upper and lower disposed nuts 100 and 102. In the preferred arrangement washer or thrust members 104 and 106 are each situated about support shaft 96 and respectively between nut 100 and plate 92 and between nut 102 and plate 92.

The position of the support rod 96, and consequently the stopper rod 12 carried thereby is established by the appropriate loosening and tightening of the nuts 100 and 102 to thereby threadably lock the shaft 96 relative to the support wall 92.

It is known in the art to preferably provide various mechanisms carried as by the stopper rod tower 18 in order to obtain proper alignment of the stopper rod 12 and end 68 relative to the conformation of the nozzle 70. The step-like collar member 108 situated atop lower end wall 84 is intended merely to depict that some prior art alignment mechanism may comprise portions thereof located in such area whereby transverse movement of such member 108 may be employed for attaining desired alignment. However, since this invention is not in any way dependent upon a particular alignment mechanism or on any particular configuration or design of a stopper rod alignment mechanism, no such alignment mechanism is herein disclosed and described.

The lower end of the support shaft 96 is provided with a disk-like end flange 110 against the lower surface 112 of which the upper axial end 114 of stopper rod 12 is abutted. In the art, there are various ways in which the stopper rod is fixedly secured to the lower end of the support rod 96. The invention is not dependent upon any particular apparatus or method of securing the stopper rod 12 to the support rod or shaft 96. Therefore, such means for interconnection is simplistically depicted as comprising a first formed member 116 which may be suitably fixedly secured to the end flange 110 as by, for example, welding. A cooperating formed clamping plate 118 is shown placed against the stopper rod 12, at a side thereof opposite to member 116 and bolted, as by bolts 120 and 122 and nuts 124 and 126, sufficiently tight (in conformance with good practice) as to hold the stopper rod 12 and support shaft or rod 96 as a functionally unitary structure.

Figure 3:
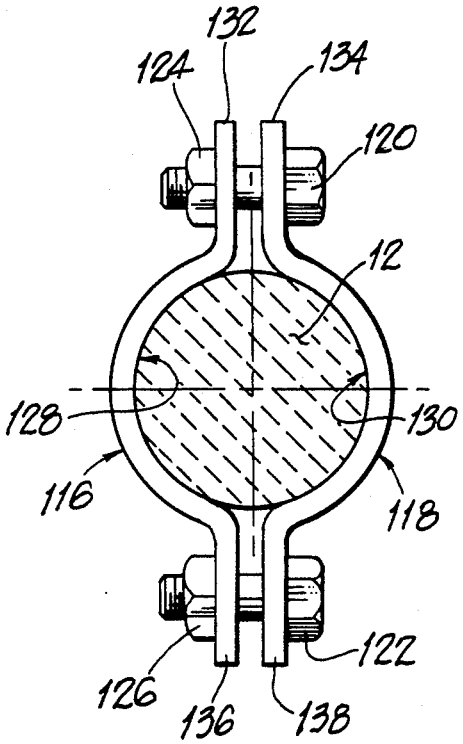
FIG. 3 is a relatively enlarged cross-sectional view taken generally on the plane of line 3—3 of FIG. 2 and looking in the direction of the arrows.

As best seen in FIG. 3, the generally mid-portions 128 and 130 of member 116 and clamp 118 are of a generally cylindrical configuration conforming to that of stopper rod 12. Outwardly extending arm-like portions 132 and 134 respectively of member 116 and clamp 118 serve to accept and carry the tightening bolt 120 and nut 124 and, similarly, arm-like portions 136 and 138 respectively of member 116 and clamp 118 serve to accept and carry the tightening bolt 122 and nut 126. It is understood that good practice requires the placement of, for example, ¼ inch (6.35 mm.) thick heat resistant insulation as: (a) between stopper rod upper end surface 114 and support rod 96 lower end surface 112; (b) between the inner surface 128 of member 116 and stopper rod 12 and (c) between the inner surface 130 of clamp 118 and stopper rod 12. However, such insulation forms no part of the invention and the showing thereof is omitted from the drawings.

Figure 4:
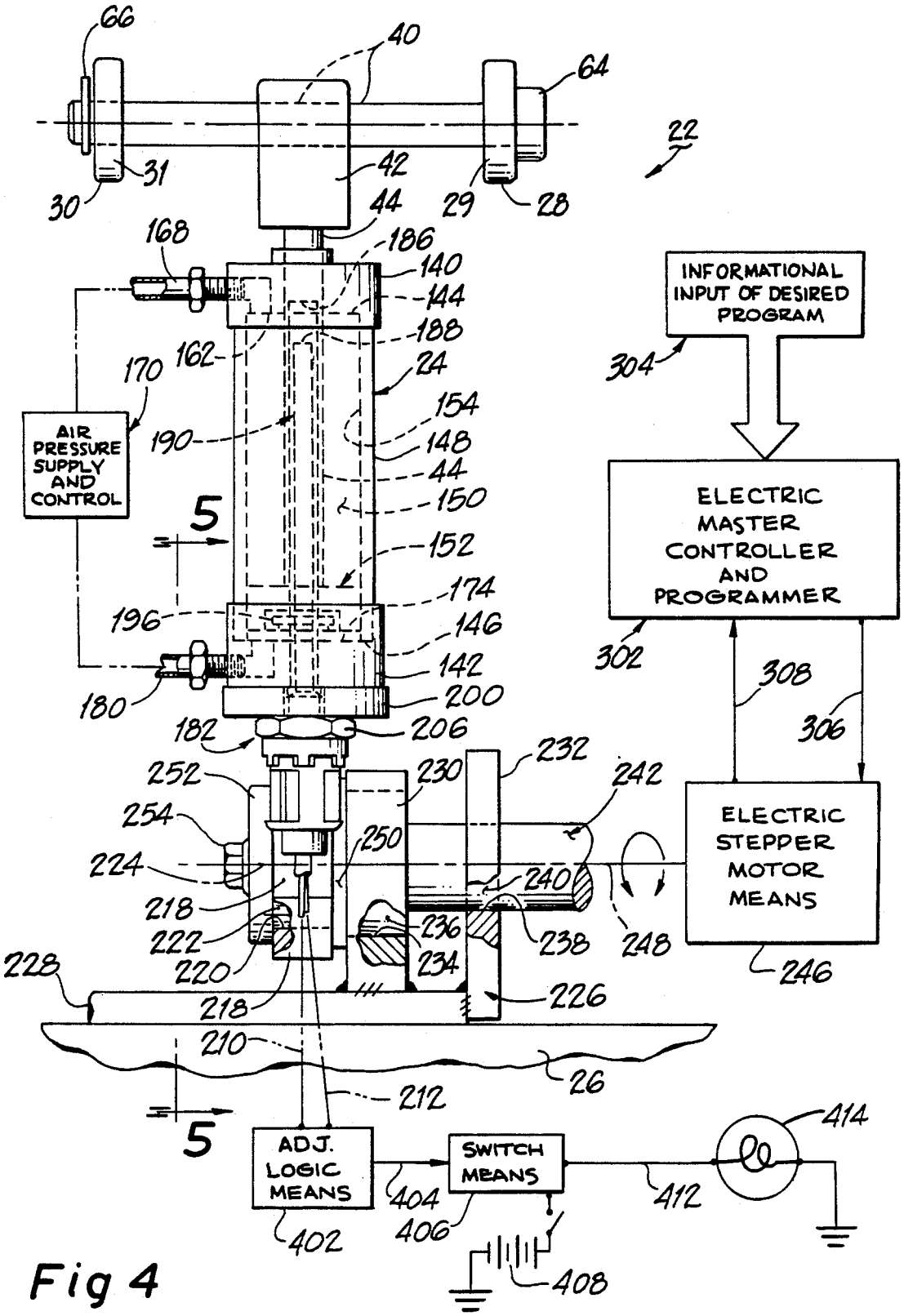
FIG. 4 is a relatively enlarged elevational view taken generally on the plane of line 4—4 of FIG. 1 and looking in the direction of the arrows and further illustrating, generally schematically, operationally related elements and assemblies.
Figure 9:
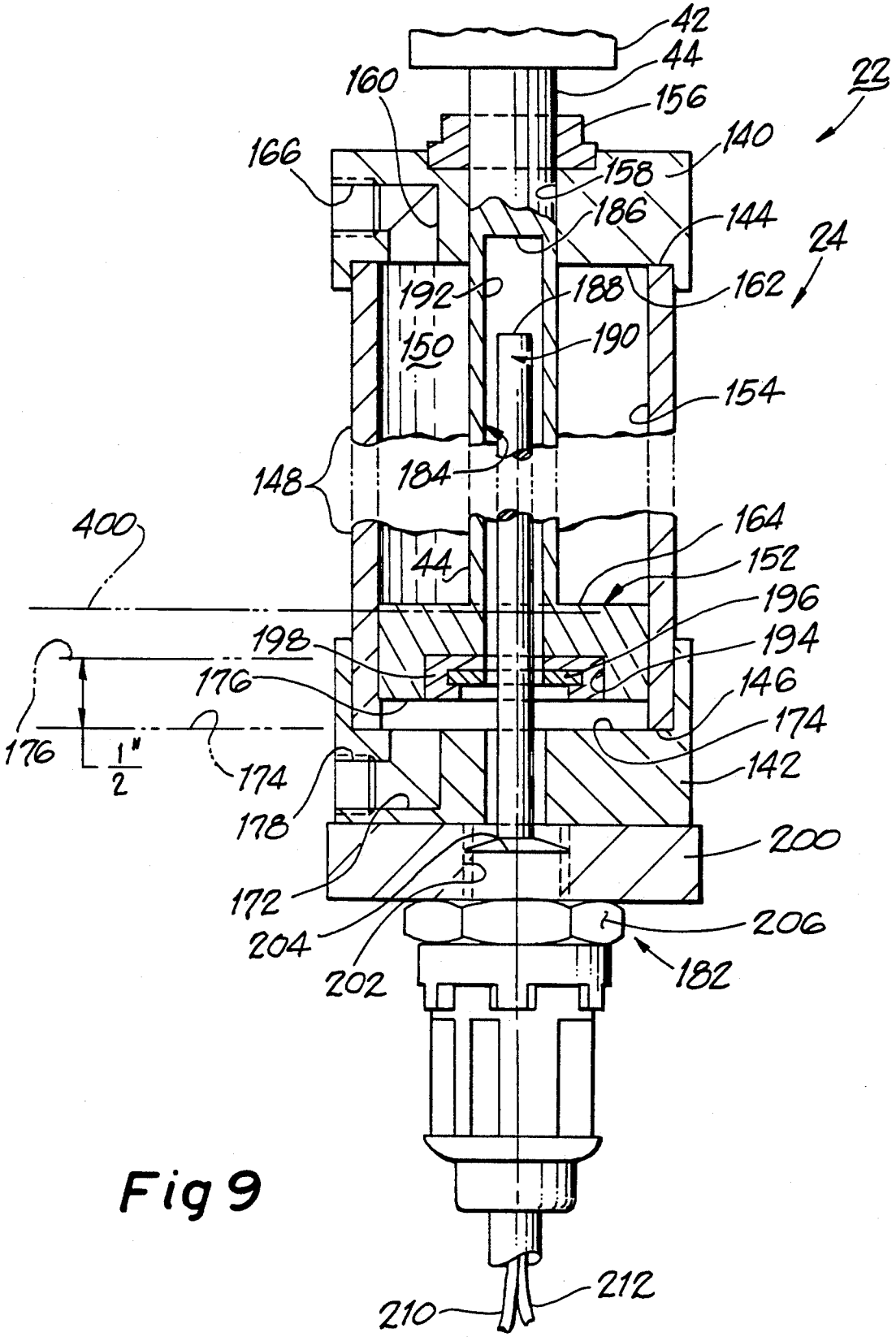
FIG. 9 is a relatively enlarged axial cross-sectional view of certain of the elements shown in FIGS. 1, 4 and 5, with a portion thereof being broken away.

Referring now in greater detail to FIG. 4, the actuator assembly 22 is shown in combination with related controls and elements. In considering the piston and cylinder assembly 24 of FIG. 4, it may be best to, at the same time, consider assembly 24 as also shown in relatively enlarged axial cross-sectional view in FIG. 9;

such FIG. 9 is presented to make it easier to understand the elements comprising piston and cylinder assembly 24.

Accordingly, referring to both FIGS. 4 and 9, the piston-cylinder assembly 24 is depicted as comprising cup-like end members 140 and 142 which cooperate with an intermediate tubular body 148 to define a cylindrical chamber 150. Ends 144 and 146 of body 148 may be respectively received by end members 140 and 142. End members 140, 142 and body 148 may be held in assembled relationship by any suitable means many of which are well known in the art.

A piston 152, carrying the generally cylindrical piston shaft 44, is slidably received with cylindrical chamber 150 as to be in operative sliding contact with the inner cylindrical surface 154 of body 148.

End member 140 is shown provided with a suitable bushing-like seal 156 for guiding piston shaft 44 and preventing the leakage of any pressure fluid from chamber 150 and through any clearance between passage 158, in end member 140, and the juxtaposed portion of piston shaft 44.

An actuating fluid passage 160 is formed in end member 140 as to communicate with chamber 150 between an inner end face 162 of end member 140 and upper (as viewed in FIG. 9) axial end surface 164 of piston 152. Passage 160 may be provided with an internally threaded portion 166 for operative connection to conduit means 168 leading to a source of air pressure 170 ( FIG. 4 ).

A second actuating fluid passage 172 is formed in end member 142 as to communicate with chamber 150 between an inner end face 174 of end member 142 and lower (as viewed in FIG. 9) axial end surface 176 of piston 152. Passage 172 may be provided with an internally threaded portion 178 for operative connection to conduit means 180 leading to the source of air pressure 170.

For purposes of discussion and disclosure it may be assumed that when piston 152 is moved upwardly to a maximum position by the fluid admitted via conduit or passage 172, the upper end face 164 of piston 152 will operatively abut against inner end face 162 of end member 140. Likewise it may be assumed that when piston 152 is moved downwardly to a maximum position by the fluid admitted via passage 160, the lower end face 176 of piston 152 will operatively abut against inner end face 174 of end member 142.

In the preferred embodiment the actuator means 22 is provided with a linear displacement transducer assembly 182. In one successful embodiment, the linear transducer 182 was combined with the piston-cylinder assembly 24 in a manner whereby the means sensitive to linear displacement were situated internally of the piston-cylinder assembly 24.

In the preferred embodiment, a Temposonics brand linear displacement transducer would be employed. The internal operation of such Temposonics transducers, as well as sizes and types, is disclosed in a sales type catalog captioned "Temposonics II, Linear Displacement Transducers" (ordering guide-Revision D). The catalog is published by MTS Systems Corporation (which is the producer of Temposonics transducers) having a mailing address of Box 13218 and offices at Research Triangle Park, N.C., U.S.A. The said catalog bears an undated copyright notice of MTS Systems Corporation and also bears what appears to be its own publication number: 1191-550055 Rev. A. Additional corporate sales offices of MTS Systems Corporation have an address of 3001 Sheldon Drive, Gary, N.C.

Still referring to FIGS. 9 and 4, the piston shaft 44 is shown having an axial extending bore 184 formed therein which axially terminates as at 186. The length and diameter of the bore 184 is such as to assuredly provide an axial clearance between bore end 186 and the juxtaposed end 188 of the transducer rod 190 as well as a radial clearance between the axially extending inner wall 192 of bore 184 and transducer rod 190.

The piston 152 has a counterbore 194 formed therein which is axially aligned with piston shaft bore 184. A ring magnet 196 is held in the counterbore 194 by a generally annular non-ferrous retainer 198. In the preferred arrangement, the bore 184 of piston rod 44 extends through the piston 152 and retainer 198 while the retainer 198 serves to hold ring magnet 196 in its position generally circumscribing transducer rod 190.

In the preferred embodiment, an extra metal plate member 200 is suitably fixedly secured to end member 142 as by suitable screws (not shown). An internally threaded portion 202 in member 200 threadably engages an externally threaded portion 204 of the transducer assembly 182, the tightening of which may be accomplished by a suitable tool cooperatively engaging the tool-engaging surface means 206 of the transducer 182. Preferably, end member 142 is also provided with a diametrically relatively enlarged passage 208 for the free extension therethrough of the transducer rod 190.

Generally, the transducer 182 provides an output signal via conductors 210 and 212 with such signal being directly related to the then axial location of the ring magnet 196 relative to the transducer rod 190.

Figure 5:
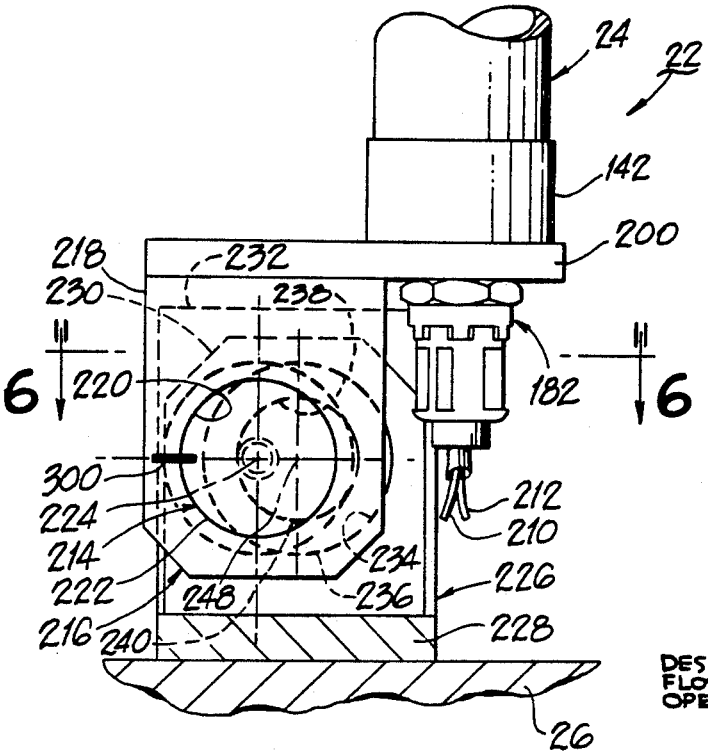
FIG. 5 is a fragmentary elevational view, with a portion in cross-section, taken generally on the plane of line 5—5 of FIG. 4 and looking in the direction of the arrows.
Figure 6:
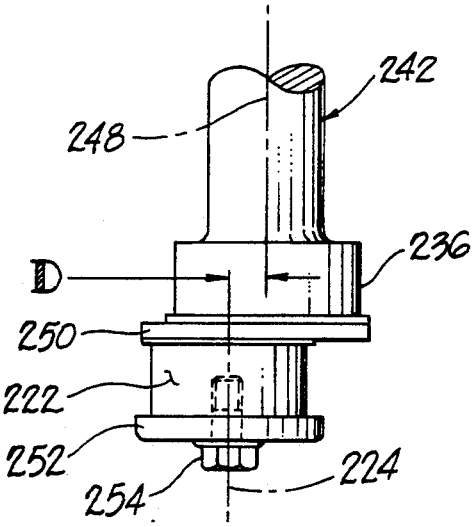
FIG. 6 is a view mainly of one of the elements shown in FIG. 5, taken generally on the plane of line 6—6 of FIG. 5 and looking in the direction of the arrows.

Referring now primarily to FIGS. 4, 5 and 6, the actuator means 22 is depicted as also comprising variably and selectively positionable cam means 214 effective to at times vary the position of the piston-cylinder assembly 24 and thereby vary the position (relative elevation) of end 68 of stopper rod 12 (FIGS. 1 and 2).

A first movable bearing block arrangement 216 is comprised of the generally horizontally extending member 200 and a bearing member 218, suitably secured at its upper end to horizontal member 200 as by any suitable means. A cylindrical bearing surface 220 is formed in or carried by the bearing block or plate 218 and a cylindrical cam portion 222 is closely slidably received by such bearing surface 220. The centerlines or axes of the bearing surface 220 and the cylindrical bearing portion 222 are generally coincident and depicted as being at point 224 of FIG. 5.

A second bearing block arrangement 226 comprises a base plate 228 and spaced vertical plates or members 230 and 232 each rigidly secured to and carried by the base plate 228 which, in turn, is suitably fixedly secured to the support flange 26 as by, for example, a plurality of bolts (not shown).

Vertical plate or body 230 has a cylindrical bearing surface 234 formed in or carried thereby which closely receives a second cylindrical bearing portion 236. The vertical plate or body 232 has a cylindrical bearing surface 238 formed in or carried thereby which closely receives a third bearing portion 240 which, in fact, may comprise a portion of a cylindrical shaft 242 extension operatively connected to associated electric stepper motor means 246.

The centerlines or axes of the bearing portion 236 and bearing portion 240 are in reality one and the same with such being indicated by point 248 in FIG. 5. As should be apparent from the conditions depicted in FIGS. 4 and 5, respective centerlines or axes 224 and 248 are parallel to each other and contained in the same plane.

The view taken on the plane of line 6—6 of FIG. 5 is also parallel to the axes 224 and 248 and therefore the distance, D, by which the axes 224 and 248 are displaced from each other, as depicted in FIG. 6, comprises the eccentric between axes 224 and 248 as depicted in FIG. 5.

If stepper motor 246 were caused to rotate shaft 242 360° in the clockwise direction, as viewed in FIG. 5, axis 248 of the bearing 236 would remain as shown in FIG. 5; however, axis 224 of bearing 222 would move in a circular pattern about axis 248 and at a distance or radius D from axis 248 returning, at its 360th degree of travel, to its position shown in FIG. 5. Such assumed 360° movement of axis 224 is, of course, accompanied by the movement of cylindrical bearing portion 222. In the first 90° of rotation, axis 224 would be immediately vertically above and spaced from axis 248 by the eccentric distance, D. In reaching the first 90° of rotation, bearing member 222 would, starting from its position depicted in FIG. 5, begin to raise or lift the bearing block arrangement comprised of members 200 and 218. The amount of such lifting would increase until said axis 224 is immediately above and spaced from axis 248; at that time the cam or bearing portion 222 would have lifted the bearing block arrangement 200 and 218 a distance, D , and as viewed in FIG. 5, also moved the bearing block arrangement 200 and 218 a distance, D , to the right as viewed in FIG. 5. Of course, as member 200 is thusly positioned in response to the movement of cam or bearing 222 about axis 248, the piston-cylinder assembly 24, especially the lower end 142 thereof as viewed in FIG. 5 is caused to follow.

When the axis 224 reaches the 180° of travel, cam member 222 again lowers the bearing block arrangement 200, 218 to the elevation depicted but causes such bearing block arrangement 200, 218 to move to the right another distance, generally to the right of shaft axis 248.

When the axis 224 reaches the 270° of travel (such being immediately below and spaced from shaft axis 248), cam or bearing member 222 lowers the bearing block arrangement 200, 218 by a distance equal to distance, D, directly below axis 248. At the same time cam or bearing member 222 moves the bearing block arrangement 200, 218 leftward (from its right-most location when axis 224 was at its 180° position). Of course, when axis 224 and cam or bearing member 222 reach their 360° travel position, the respective elements again assume their positions depicted in FIG. 5.

In the preferred arrangement, a diametrically enlarged shoulder-like portion 250 is formed generally axially between bearing portions 236 and 222 and a stop or retainer disk 252 is secured, as by a screw 254, to the free end of cam or bearing portion 222.

Operation

In view of the disclosure thus far made of the invention, it should be apparent that when piston 152 is caused to be moved downwardly in the cylinder 148, or, in other words the piston rod 44 is being withdrawn into cylinder 148, pin or rod 40 is caused to correspondingly move downwardly (FIGS. 1 and 4) thereby likewise moving ends 31 and 29 of levers 30 and 28 downwardly in a pivoting or rotating motion about pivot pin or rod 32 (FIG. 1 ). This, in turn, causes ends 27 and 33 of levers 28 and 30 (FIG. 2) to be raised upwardly and accordingly raising the stopper rod tower 38 and stopper rod 12 which is connected to the tower 38 via shaft or rod 96. The stopper rod 12, if previously seated against nozzle 70, is now raised away from nozzle 70.

If now at such an assumed condition the piston rod 44 is made to further extend from the piston-cylinder assembly 24, it should also be apparent that pin or rod 40 (FIGS. 1 and 4) is caused to correspondingly move upwardly thereby likewise moving ends 31 and 29 of levers 30 and 28 upwardly in a pivoting or rotating motion about pivot pin or rod 32 (FIG. 1). This, in turn, causes ends 27 and 33 of levers 28 and 30 (FIG. 2) to be lowered thereby accordingly lowering the stopper rod tower 38 and stopper rod 12 which is connected to the tower 38 via shaft or rod 96. The stopper rod 12, if previously raised away from nozzle 70 is now brought down toward nozzle 70 and if the travel of the piston rod 40 is sufficient, the stopper rod 12 will seat against the nozzle 70.

Further, it can be seen that even if the piston 152 and piston rod 44 are somehow made to be in what may be referred to as a locked position with respect to the cylinder 148, the camming means and electric stepper motor means 246 are able to cause a change in position of the stopper rod 12.

In view of previous discussion, it should be apparent that if the stepper motor 246 should rotate the cam or bearing portion 222 clockwise from the position depicted in FIG. 5, one of the consequences thereof is to cause the entire piston-cylinder assembly 24 to be raised in accordance with the degree of eccentricity operating in an upward direction. Also, it should be apparent that if the stepper motor 246 should rotate the cam or bearing portion 222 counter-clockwise from the position depicted in FIG. 5, one of the consequences thereof is to cause the entire piston-cylinder assembly 24 to be lowered in accordance with the degree of eccentricity operating in a downward direction.

Therefor, the broad line 300 indicated in FIGS. 5 and 1 may be considered at least a quasi gauge point representing a zero upward or downward influence on the bearing block arrangement 200, 218 and on the piston-cylinder assembly 24 when the cam or bearing 222 is positioned such as to have its portion of the gauge point or line in alignment with the remainder of such gauge line. This, in the embodiment disclosed would occur when axes 224 and 248 are in the same horizontal plane and axis 224 is to the left (as viewed in FIG. 5) of axis 248.

Now, continuing with the assumption that the piston rod and piston are operatively locked with respect to cylinder 148, if the stepper motor means 246 rotates the cam or bearing member 222 in a direction counter-clockwise about axis 248, the cam member 222 will move the bearing block arrangement 218,200 downwardly and, along with it, move piston-cylinder assembly 24 downwardly. The piston 152 being assumed stationary in cylinder 148 results in piston rod 44, through rod or pin 40, moving ends 31 and 29 of levers 30 and 28 pivotally downwardly about pivot pin 32 (FIG. 1). This, in turn, causes ends 27 and 33 of levers 28 and 30 to move upwardly and thereby move stopper rod tower 18 and stopper rod 12 upwardly.

Still continuing with the assumption that the piston rod 44 and piston 152 are operatively locked with respect to cylinder 148, and assuming that the stopper rod 12 is in some position raised from nozzle 70, if the stepper motor means 246 rotates the cam or bearing member 222 (from its position depicted in FIG. 5) in a direction clockwise about axis 248, the cam member 222 will move the bearing block arrangement 218, 200 upwardly and, along with it, move piston-cylinder assembly 24 upwardly. The assumed locked piston rod 44, through rod or pin 40 moves ends 31 and 29 of levers 30 and 28 pivotally upwardly about pivot pin 32 (FIG. 1). This, in turn, causes ends 27 and 33 of levers 28 and 30 to move downwardly and thereby move stopper rod tower 18 and stopper rod 12 downwardly.

Referring to FIG. 4 an electric or electronic controller 302 is selectively programmed with informational input 304 representing the desired pouring cycle of the molten material. Many of such controllers 302 and many means of informational input 304 are well known and employed in the art. For purposes of discussion, FIG. 7 illustrates, by way of example, a desired pouring curve which, it may be assumed, the controller and programmer 302 has been instructed, via 304, to produce as an overall pouring cycle.

In the preferred arrangement, the stepper motor means 246, which has a fixed relationship to shaft 242 and therefore cam 222, is in a closed loop with controller-programmer 302. That is, when appropriate the controller 302 sends a signal via 306 to stepper motor means 246 indicative of the position to which the cam member 222 is to be turned. The stepper motor 246 responds and simultaneously sends back a changing signal, via 308, to the controller 302. When the magnitude or character of the signal via 308 operationally matches that via 306, the stepper motor stops since the cam member 222 has attained the position dictated by the controller 302.

Prior to the pouring of molten material, the stopper rod 12 will be seated against nozzle 70 and stepper motor 246 and cam member 222 will each be in positions whereat cam 222 will be in its neutral position as depicted by the gage point 300 of FIGS. 1 and 5. Also, piston 152 (FIGS. 4 and 9) will be displaced some preselected distance away from abutment or axial end face 174 of end member 142. Further although shown separately, the air pressure supply and control 310 may also be operatively connected to the controller 302 for receiving control signals from controller 302.

Figure 8:
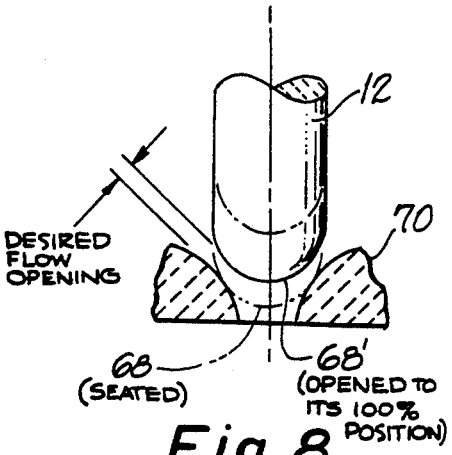
FIG. 8 is an elevational view of a fragmentary portion of a stopper rod and a fragmentary portion of a cooperating nozzle shown in cross-section.
Figure 7:
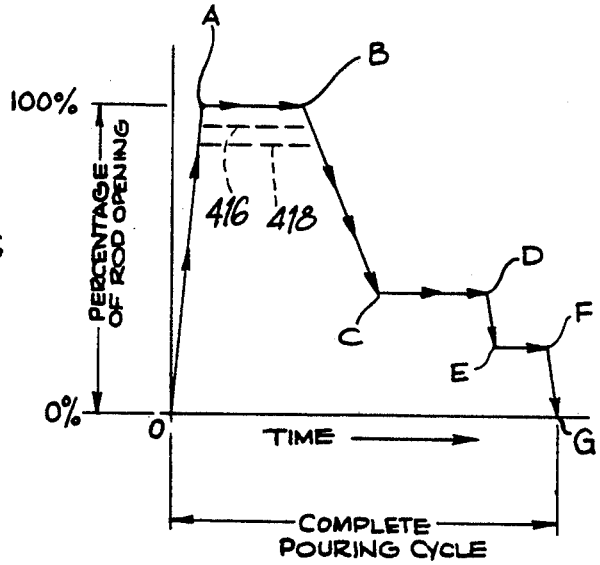
FIG. 7 is a graph showing by example the amount of opening of a stopper rod plotted against a complete pouring cycle in terms of time.

At this time, referring to FIG. 7, everything is at condition zero. Air pressure is applied to cylinder chamber 150 via conduit means 168 causing piston 152 to move downward toward and operatively abut against axial end surface 174. Such downward movement of piston 152, as previously described causes the stopper rod 12 to move upwardly to a position depicted at 68 of FIG. 8 and identified as being that position of stopper rod 12 "opened to its 100% position".

Referring again to FIG. 7, as the stopper rod 12 starts to open towards its 100% position, the pouring of molten material follows or produces the graph from point zero to point A. Once the pour rate reaches point A it continues at a steady rate until reaching point B. At point B, the controller 302 has instructed, via 306, electric stepper motor means to decrease the rate of pouring from the ladle and this, of course, must be accomplished by bringing the stopper rod 12 from it 100% position toward the nozzle 70. This is achieved by having the stepper motor rotate cam member 222 (FIG. 5) in a generally clockwise direction thereby progressively raising the piston-cylinder assembly 24 (with piston 152 still in abutment with end surface 174) and likewise progressively lowering the stopper rod tower 18 and stopper rod carried thereby so as to progressively diminish the flow of molten material through the nozzle 70. Such a progressive reduction of flow may occur as to point C at which time the stepper motor means 246 has indicated, via 308, to the master controller that it, stepper motor 246, and cam member 222 have attained the condition or position specified by the controller-programmer 302.

Again, as between points C and D the opening between stopper rod 12 and nozzle remain constant (as dictated by the controller-programmer 302) and therefore the rate of flow of molten material through the nozzle 70 remains generally constant between C and D. The other points E, F and G if desired, may be similarly determined.

If in FIG. 7 the 100% opening represents the desired rate of flow, then to assure uniformity of castings every stopper rod, employed in combination with a ladle having a nozzle, must move, in its initial opening movement, exactly the same distance away from the nozzle.

This has been and continues to be a problem in the prior art. That is, usually at least on a daily basis the previously used stopper rod 12 and previously used nozzle are removed and replaced by a "new" stopper rod 12 and a "new" nozzle. The "new" nozzle 70 would be fitted into the ladle structure and the "new" stopper rod 12 would be attached to the support rod 96 generally in the manner described with reference to FIG. 2.

Now, let it be assumed that in order to obtain the desired flow rate at a so called 100% opening, that the stopper rod 12 would have to be raised to its 68' position. Further, it is to be remembered that the initial opening of the stopper rod 12 is brought about strictly and only by the piston 152 being moved (by air pressure) against the cooperating abutment surface 174. And, further, for purposes of illustration let it be assumed that in order to initially raise the stopper rod 12 to its 68' position, the piston 152 must experience a total travel of 0.50 inch (12.7 mm.) before abutting against end wall 174.

In the prior art, once the "new" stopper rod 12 is secured to the support shaft 96, and aligned, the s topper rod 12 is permitted to rest, seated as depicted in FIGS. 1 or 2, and by manual alternate loosening and tightening of the nuts 100 and 102 an attempt is made to position the piston 152 the required 0.5 inch distance from abutment wall 174.

That is, because the "new" stopper rod 12 is sufficiently heavy, it will stay seated as in FIG. 2; however, as the nuts 100 and 102 are threaded upwardly on support shaft threads 98, the effect of that is to relatively raise the stopper rod tower 18 and by so doing pivot levers 28 and 30 (FIG. 1) clockwise about pivot pin 32 causing the piston rod 44 and piston 152 to be moved downwardly in the cylindrical body 148. The problem was and is, that not being able to see into the cylinder 148 there is no way of knowing how much space exists between the piston 152 and abutment wall 174.

Attempts have been made to measure the movement of the piston shaft 44 and employ such measurement at the screws 100 and 102 (FIG. 2). However, this prior art method is time consuming and the required accuracy is not attained especially when one manually alternately loosens and tightens the nuts 100 and 102 while attempting to get them both tightened to establish the required (assumed) initial 0.5 inch travel of the piston 152.

The invention totally overcomes such prior art problems.

Referring to both FIGS. 4 and 9, but mostly to FIG. 9, the transducer 182 operates in a manner whereby differing outputs are provided on conductors 210 and 212 depending upon the location of the ring-like magnet 196 along the axial length of the transducer rod. That is, for every incremental change in axial location of ring magnet 196 relative to transducer rod 190, a different magnitude or characteristic signal will be produced at output terminals or conductors 210 and 212.

Referring to both FIGS. 4 and 9, and in particular to FIG. 9, adjustable logic means 402 may be provided for receiving the output signals of conductors 210 and 212. The logic means 402 will not respond to any other input from conductors 210 and 212 other than an output which is of either a magnitude or characteristic that is developed when axial end 176 of piston is 0.5 inch away from coacting abutment surface 174. Therefore, the piston-cylinder assembly 24 as drawn in FIG. 9 would produce an output on conductors 210, 212 leading to the logic means 402. However, the logic means would not respond to such because end face 176 of piston 152 is less than 0.5 inch away from abutment face 174.

However, when piston 152 is moved upwardly (as viewed in FIG. 9) to where the end face 176 of piston 152 is at a distance designated by phantom line 176, the distance between the piston end face 176 and abutment surface 174 is equal to 0.5 inch. Further, such upward movement of piston 152 also moves the ring magnet 196 upwardly a corresponding distance. For clarity only a mid-plane of the ring magnet 196 is depicted by the phantom line 400. At this location of the ring magnet 196, with respect to the transducer rod 190, a particular output is provided on conductors 210 and 212. Since the logic means 402 has been adjusted or programmed to favorably respond to the said particular output, the logic means 402, in turn, provides an output via 404 to suitable switch means 406 which through a source 408 of electrical potential causes, via 412, energization of sensory signal means 414 which, in the preferred embodiment would comprise suitable lamp means. If the piston 152 is moved axially to either side (of its phantom line depicted positions) the said particular output signal would cease to exist and, of course, the sensory signal means 414 would become de-energized.

Now, instead of following the procedures of the prior art, the "new" nozzle 70 is assembled to the ladle and the "new" stopper rod 12 is secured to the support shaft 96, aligned with the nozzle 70 and because the "new" stopper rod 12 is sufficiently heavy it will stay seated as in FIG. 2.

All that now has to be done is to appropriately turn the nuts 100 and 102 on shaft 96 and thereby raise or lower the stopper rod tower 18 and conversely lower or raise the piston 152 within cylinder 148. While doing this if the output signal light 414 becomes energized, the operator knows that the piston 152 is in precisely its proper location and all that needs to be done is to tighten the nuts 100 and 102 to fixedly secure the support shaft 96 and stopper rod 12.

The apparatus is now ready for pouring molten material. As before, air pressure moves piston 152 against abutment surface 174 causing the stopper rod and stopper rod tower 18 to move upwardly to where end 68 of stopper rod 12 is now in its 100% open position as depicted by 68' of FIG. 8.

By employing the invention it is assured that point A of FIG. 7 will always be at that elevation and that no other erroneous 100% openings will occur and establish maximum pours as generally depicted by dash lines 416 and 418.

The transducer disclosed is one which is internal; however, it should be obvious that externally situated transducer or transducers may function equally well.

Although only a preferred embodiment of the invention has been disclosed and described it is apparent that other embodiments and modifications are possible within the scope of the appended claims.

What is claimed:

1. Apparatus for controllably pouring molten material from a ladle having a pouring nozzle, comprising a stopper rod for opening and closing said nozzle, a stopper rod support structure, wherein said support structure comprises manual adjustment means for adjusting the position of said stopper rod relative to said support structure, pressure responsive piston and cylinder means operatively connected to said support structure and effective to move said support structure and said stopper rod to a preselected opened position relative to said nozzle, a driving motor, camming means operatively interposed between said driving motor and said piston and cylinder means, wherein prior to said piston and cylinder means moving said support structure said support structure and stopper rod are in a position wherein said stopper rod is closed against said nozzle and said piston of said piston and cylinder means is situated a preselected distance away from an end travel of said piston, further comprising electrical means for sensing the position of said piston within said cylinder, said electrical means being effective to sense when said piston is at said preselected distance and produce an output signal indicative thereof, wherein initial pouring of said molten material from said ladle occurs when said piston moves said preselected distance within said cylinder to said end travel of said piston, and wherein the pouring of said molten material following said initial pouring is accomplished by said drive motor driving said camming means and having said camming means move said support structure and stopper rod by moving said piston and said cylinder means while said piston remains at said end travel within said cylinder.

2. Apparatus according to claim 1 wherein said electrical means comprises electrical transducer means.

3. Apparatus according to claim 1 wherein said electrical means comprises electrical transducer means, wherein at least a major portion of said electrical transducer means is carried by said piston and cylinder means.

4. Apparatus according to claim 1 wherein said electrical means comprises electrical linear transducer means, and wherein at least a major portion of said electrical linear transducer means is carried by said piston and cylinder means.

5. Apparatus according to claim 1 and further comprising sensory signal generating means, said sensory signal generating means being effective to produce a sensory signal upon receiving said output signal.

6. Apparatus according to claim 5 wherein said sensory signal generating means comprises an electrically energizable lamp.

7. Apparatus according to claim 1 and further comprising at least first and second levers, a lift tower pivotally supporting said first and second levers, wherein respective first ends of said first and second levers are pivotally connected to said support structure, and wherein respective second ends of said first and second levers are pivotally connected to said piston and cylinder means.

8. Apparatus according to claim 1 wherein said stopper rod support structure comprises a support shaft operatively connected at one end to said stopper rod, wherein said support shaft comprises an externally threaded portion at least near a second end thereof generally opposite to said one end, wherein said externally threaded portion cooperates with threaded nuts as to adjust the position of said stopper rod relatively to said support structure, wherein adjusting of said nuts with said stopper rod being in its closed position achieves movement of said piston to said preselected distance away form said end travel of said piston.

9. Apparatus for controllably pouring molten material from a ladle having a pouring nozzle, comprising a stopper rod having an end for opening and closing said nozzle, a support head situated generally above said stopper rod, a threadable connection generally between said stopper rod and said support head, wherein said threadable connection comprises threaded adjustment nuts, wherein selective adjustments of said adjustment nuts of said threadable connection causes relative movement between said support head and said stopper rod relatively toward each other or relatively away from each other, a pivotal lever having first and second operative ends and supporting pivot means for pivotally supporting said pivotal lever generally intermediate said first and second operative ends, wherein said first operative end is operatively pivotally connected to said support head, a pressure responsive piston and cylinder assembly, wherein said piston is operatively connected to said second operative end of said pivotal leer, a drive motor, camming means, wherein said drive motor is effective to at times drive said camming means, stop means carried by said cylinder for limiting the travel of said piston relative to said cylinder, wherein selective adjustment of said adjustment nuts causes pivotal motion of said pivotal lever and movement of said piston within said cylinder, wherein upon the sufficient selective adjustment of said adjustment nuts said piston is caused to be positioned a preselected distance away from said stop means, electrical means for sensing the position of said piston within said cylinder, said electrical means being effective to sense when said piston is at said preselected distance and produce an output signal indicative thereof, wherein initial pouring of said molten material from said ladle occurs when said piston moves through said preselected distance and against said stop means, and wherein the pouring of said molten material from said ladle following said initial pouring is accomplished by said piston remaining against said stop means and said drive motor driving said camming means to move said piston and cylinder assembly in accordance with a program defined by said camming means and to thereby variably control the rate of flow of said molten material from said ladle nozzle by movement of said stopper rod toward said nozzle.

10. Apparatus for controllably pouring molten material from a ladle having a pouring nozzle according to claim 9 wherein said output signal comprises a sensory signal.

11. Apparatus for controllably pouring molten material from a ladle having a pouring nozzle according to claim 10 wherein said sensory signal comprises an electrically energizable lamp.

12. An arrangement for pouring molten material from a ladle having a pouring nozzle and a stopper rod for at times terminating the flow of said molten material from said pouring nozzle, a piston and cylinder assembly, a support structure generally above said stopper rod operatively connected to said stopper rod for movement in unison, wherein said support structure and said stopper rod are connected to each other by threadable adjustment members, linkage means operatively connecting said support structure and said piston, a stop carried by said cylinder for limiting the movement of said piston by abutting against said stop, and driven cam means for at times moving both said cylinder and said piston, with said stopper rod being in position terminating flow from said pouring nozzle said threadable adjustment members are effective to become sufficiently adjusted thereby causing said piston to move within said cylinder until said piston attains a preselected distance from said stop, wherein initial pouring of said molten material from said ladle occurs when said piston is caused to move said preselected distance to said stop, and wherein the pouring of said molten material following sad initial pouring is accomplished by said driven cam means causing said stopper rod to be lowered toward said pouring nozzle in accordance with a related program, said driven cam means achieving such by moving both said piston and said cylinder.

* * * * *

UNITED STATES PATENT AND TRADEMARK OFFICE

CERTIFICATE OF CORRECTION

PATENT NO. : 5,333,764

DATED : August 2, 1994

INVENTOR(S) : Steven M. Kassuba

It is certified that error appears in the above-identified patent and that said Letters Patent is hereby corrected as shown below:

Column 1, line 32, immediately after "a" insert --- stopper rod is replaced, that the replacing stopper rod when moved toward its initial opened position actually move to ---.

Column 1, line 64, immediately after "further" insert --- comprising transducer means for sensing the position of said piston within said cylinder, said transducer means being ---.

Column 6, line 2, change "Gary" to --- Cary ---.

Column 7, line 40, immediately after "distance," insert --- D, ---.

Column 12, line 48 (Claim 3, line 3 thereof), before "wherein" insert --- and ---.

Column 13, line 14 (Claim 8, line 12 thereof), change "form" to --- from ---.

UNITED STATES PATENT AND TRADEMARK OFFICE

CERTIFICATE OF CORRECTION

PATENT NO. : 5,333,764

DATED : August 2, 1994

INVENTOR(S) : Steven M. Kassuba

It is certified that error appears in the above-identified patent and that said Letters Patent is hereby corrected as shown below:

Column 13, line 33 (Claim 9, line 19 thereof), change "leer" to --- lever ---.

Column 14, line 41 (Claim 12, line 22 thereof), change "sad" to --- said ---.

Signed and Sealed this

Eighth Day of November, 1994

*Attest:*

*Attesting Officer*

BRUCE LEHMAN

*Commissioner of Patents and Trademarks*